US005871132A

United States Patent [19]

Hargreaves

[11] Patent Number: 5,871,132

[45] Date of Patent: Feb. 16, 1999

[54] 3 IN 1 FANNIFLAP PACK

[76] Inventor: Annette H. Hargreaves, 11804 Silent Valley La., N. Potomac, Md. 20878

[21] Appl. No.: 832,342

[22] Filed: Apr. 11, 1997

Related U.S. Application Data

[60] Provisional application No. 60/015,934 Apr. 22, 1996.

[51] Int. Cl.[6] ..... A45C 15/00; A45F 4/00; A45F 3/00; A41D 27/12

[52] U.S. Cl. ..... 224/576; 224/577; 224/581; 224/665; 224/674; 224/675; 224/681; 224/901.8; 224/268; 2/46

[58] Field of Search ..... 224/576, 577, 224/581, 665, 671, 672, 673, 674, 675, 681, 901.8, 664, 663, 268; 2/46, 48

[56] References Cited

U.S. PATENT DOCUMENTS

| | | | |
|---|---|---|---|
| 3,212,690 | 10/1965 | Green | 224/675 |
| 5,003,634 | 4/1991 | Brinkman | 224/664 |
| 5,241,706 | 9/1993 | Netz | 2/46 |
| 5,275,315 | 1/1994 | Carmack et al. | 224/664 |
| 5,491,843 | 2/1996 | Naughton | 2/48 |
| 5,609,283 | 3/1997 | Harrison, Jr. | 224/677 |
| 5,625,895 | 5/1997 | Sovereign | 224/677 |

*Primary Examiner*—Linda J. Sholl
*Attorney, Agent, or Firm*—Richard C. Litman

[57] ABSTRACT

A three in one belt pack having in combination a conventional pack, a cushion-flap, and a belt. The cushion-flap selectively attaches via hook and loop fasteners to the belt on the inside of the pack, if the pack is being worn. When attached to the belt inside the pack the cushion-flap can be rolled up and placed inside the pack for storage. The user has the option of using a cushion-flap having a humorous design, school logo or message thereupon. When used in protection or display mode, the cushion-flap functions as a seat comfortable, waterproof cushion, a walking display and as a protective barrier shielding the user's clothing from becoming soiled due to filthy chairs or benches. The cushion-flap is made of a double sided nylon neoprene material, preferably, is waterproof and thermal. The pack is detachable from the belt and has an assortment of compartments dimensioned and configured to contain various items.

11 Claims, 7 Drawing Sheets

3 IN 1 FANNIFLAP PACK

CROSS REFERENCE TO RELATED APPLICATIONS

This application claims the benefit of U.S. Provisional Application Ser. No. 60/015,934, filed Apr. 22, 1996.

BACKGROUND OF THE INVENTION

1. Field of the Invention

The present invention relates generally to belt packs and more specifically to a combination waist pack, seat cushion-flap and belt. The invention is specifically related to a belt pack incorporating three separate elements which combine together to form the 3 in 1 fanniflap pack.

2. Description of the Prior Art

Many joggers, sightseers, hikers and travelers find belt packs to be extremely convenient and handy. The packs allow free use of the hands while providing convenient and easily accessible storage compartments for the storage of such items as keys, wallets, currency, and other miscellaneous items. The user gets the benefit of the safe storage of valuables plus use of his or her hands. The packs have separate storage compartments which allow the user to isolate items such as jewelry from other items such as coins or tools. Anyone who has had the face of a valuable watch scratched will appreciate the separate compartments. Likewise, cyclists have been known to place spare inner-tubes and bicycle flat tire repair kits in the compartments. Others, such as travelers and hikers, use them in their journeys. However, travelers and hikers occasionally must sit on hard dirty benches which are hard on their buttocks and sometimes soil their clothing. Similarly, skiers are presented with the problem of sitting upon a cold metal chairlift. Conventional belt packs are not equipped with padding or any other protective device that protects the clothing from being soiled while providing a soft, insulative cushion-flap to sit upon in combination with means to store the protective devices within the belt packs while attached to the belt. Therefore, a need exists for a combination belt pack having a protective cushion-flap attachable to the belt via fasteners, wherein the cushion-flap and belt are employed either with or without the belt pack and wherein the protective cushion-flap is capable of being rolled around the belt or alternatively rolled up into a compartment of the pack. The present invention provides such an apparatus.

Combination belt packs have been described in the patent literature. For example, U.S. Pat. No. 3,185,362 issued on Jan. 30, 1964 to Wakefield, discloses a combination seat-pack which is constructed of water repellant materials. The seat-pack engages the waist in a manner similar to belt-like garments. The seat-pack is in the form of an extensible pack which may be selectively extended to function as a seat-cushion, and subsequently retracted to its original position.

U.S. Pat. No. 4,515,300 issued on May 7, 1985 to Cohen, discloses a multiple-use sports bag and method of converting it to a backpack. The sports back includes a pouch-like body having a first open storage space and a space adjacent thereto. A pack is folded and disposed within the adjacent space with Velcro strips being included to secure it. A zipper is provided for accessing the backpack, while pull tabs are disposed on the opposite sides of the zipper for opening and closing the pouch.

U.S. Pat. No. 5,150,824 issued on Sep. 29, 1992 to Alverez et al., discloses a dual purpose unitized pack suited for use as a container for holding articles. The unitized pack includes a pouch, a substantially flat enclosure member attached thereto, and a belt attached at least on one end to the pouch. An open top collapsible sack is positioned in the enclosure member and attached thereto. The open top sack is capable of being fully contained within the enclosure member.

U.S. Pat. No. 5,275,315 issued on Jan. 4, 1994 to Carmack et al., discloses a waist pack with cushion seat. The waist pack is adapted to be worn about the waist of a human and includes at least one interior compartment. A seat cushion is connected to the waist pack by means of a connecting strap. Both the connecting strap and the seat cushion are locatable in a stowage position within an interior compartment of the waist pack. The seat cushion may be extended and inflated for placement beneath the buttocks while in a sitting position.

U.S. Pat. No. 5,450,991 issued on Sep. 19, 1995 to Neading, discloses a combination storage belt and ski carrier accessory and method of conversion. The apparatus includes a belt which mounts a pair of releasably and reversibly attachable flexible members at each of a pair of opposite ends of the belt. A storage bag is positioned at an intermediate location on the flexible members on opposite ends of the belt. The belt is adjustable to convert it between a contracted position suited for wearing around the waist, and an expanded condition suited for wearing across the torso and over the shoulder.

French Pat. No. 2,577,123 issued on Aug. 14, 1986, and Switzerland Pat. No. 237,293 issued in April, 1945, both describe belt accessories but fail to disclose belt packs having seat cushions attached thereto.

None of the above inventions and patents, taken either singly or in combination, is seen to describe the instant invention as claimed.

SUMMARY OF THE INVENTION

Accordingly, it is a principal object of the invention to provide a combination belt pack.

It is another object of the invention to provide a cushion-flap capable of functioning as a comfortable, waterproof seat.

It is a further object of the invention to provide a pack that is detachable from the belt.

Still another object of the invention is to provide a cushion-flap capable of being rolled around the belt, placed into the pack when not in use, or detached completely from the belt and pack.

It is an object of the invention to provide improved elements and arrangements thereof in an apparatus for the purposes described which is inexpensive, dependable and fully effective in accomplishing its intended purposes.

In accordance with the objects of the invention, a belt pack is disclosed which includes a belt and a pack. The pack includes a plurality of compartments disposed therein. The compartments are isolated from each other so that a variety of items may be stored without being intermingled. The pack may be folded over the belt to form a loop and appropriately secured by fasteners such as snaps. The belt pack may further be provided with a cushion-flap capable of being detachably secured to the belt using various means, including hook and loop type fasteners. The cushion-flap may be used alone or in conjunction with the pack. When used alone, the cushion-flap may be stored by wrapping it around the belt. When used in combination with the pack, the cushion-flap may be rolled and stored in one of the compartments. The pack may also be used alone or in conjunction with the cushion-flap. In preferred embodiments of the invention, the cushion-flap may further incorporate designs thereon to provide aesthetic values.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
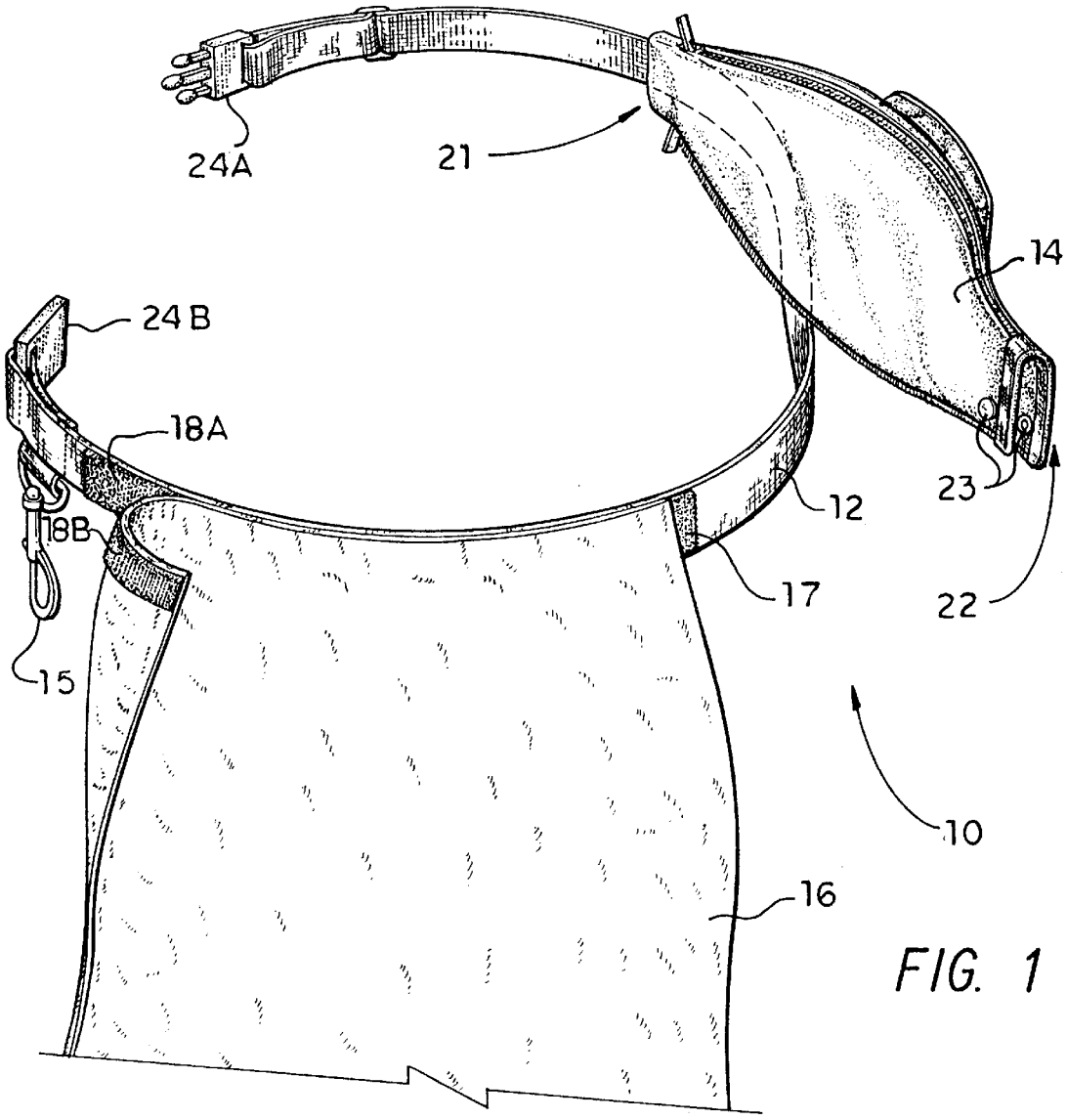
FIG. 1 is a partial perspective view of a preferred embodiment of the instant invention.

With reference to the drawings and initially to FIG. 1, a combination belt pack 10 is shown which I prefer to call the "3 in 1 Fanniflap Pack". The combination belt pack 10 includes a belt 12, a pack 14 and a cushion-flap 16. As seen in FIG. 1, the belt 12 includes a male closure 24A and a corresponding female closure 24B so that it may be fitted around a user's waist. The male closure 24A is adjustably connected to the belt 12 to allow expansion and contraction of the belt diameter for a proper fit around a range of waist sizes. The pack 14 is capable of folding over the belt 12 thereby forming a closed loop 21. The pack 14 can then be secured to itself such that the belt 12 functions as a support for the pack 14. In order to secure the pack 14, a plurality of snaps 23 are provided. The cushion-flap 16 is detachably secured to the belt 12 via hook 18B and loop 18A type fasteners correspondingly disposed on the belt 12 and the cushion-flap 16. In order to attach the pack 14 to the belt 12, the user first opens the bottom zipper and then slides the male closure 24A of the belt 12 through the closed loop 21. The closed loop 21 is then slid along the belt 12 until the closed loop 21 is near the beginning 17 of the loop type fastener 18A and a portion of the belt 12 (which includes all of the loop type fastener 18A) is positioned within the pack 14. Next the open loop 22 is placed over the belt 12 and the snaps 23 are pressed together to close the open loop 22 around the belt 12. To detach the pack 14 from the belt 12 the user pulls apart the snaps 23 and pulls the open loop 22 away from the belt 12. The user then slides the closed loop 21 along the belt 12 past the male closure 24A. The cushion-flap 16 attaches to the belt 12 via hook and loop fasteners 18B, 18A respectively. To secure the belt 12 around the user's waist, the male closure 24A is connected to the female closure 24B until a secure attachment is established. A key holder 15 optionally is attached to the belt 12 near the female closure 24B and is dimensioned and configured to securely hold key rings or other similar objects.

Figure 2:
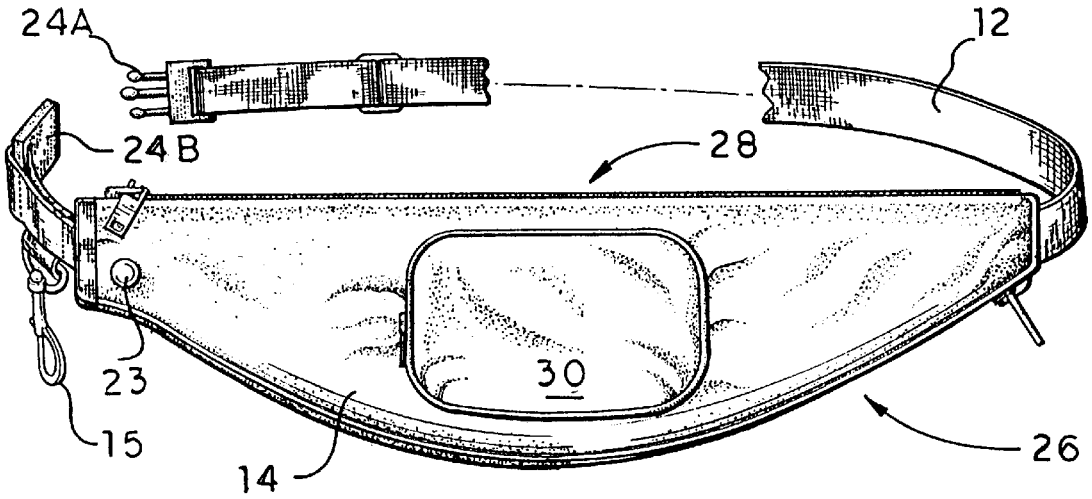
FIG. 2 is a partial front elevational view of the preferred embodiment showing the belt and pack.

Turning now to FIG. 2 of the drawings, the combination belt pack 10 is shown wherein only the pack 14 and the belt 12 of the 3 in 1 fanniflap pack are utilized. The user has the option of using the 3 in 1 fanniflap pack in various combinations. As seen in FIG. 2, the pack 14 includes a top compartment 28, a bottom compartment 26, and a rear compartment 30 which allow the user to store and transport various items. For example, the top compartment 28 could be configured to store a water bottle. Each of the compartments 26, 28, 30 are separated and accessible via zippers. It should be noted, however, that only two compartments are necessary for storage of personal items and storage of the cushion-flap 16. While the bottom compartment 26 normally is used to contain the cushion-flap 16, it may also be used to store personal items. It is also important to note that since the belt and pack have a sliding, interfitting relationship, the pack may be slid about the waist from rear to front, even when the user is seated on the flap, so that the compartments may be conveniently accessed. Thereafter, the pack may be slid out of the way again (to the user's rear) or it can be left in place in the front waist area of the user, and securely fastened by re-snapping the snaps 23 about the belt 12.

Figure 3:
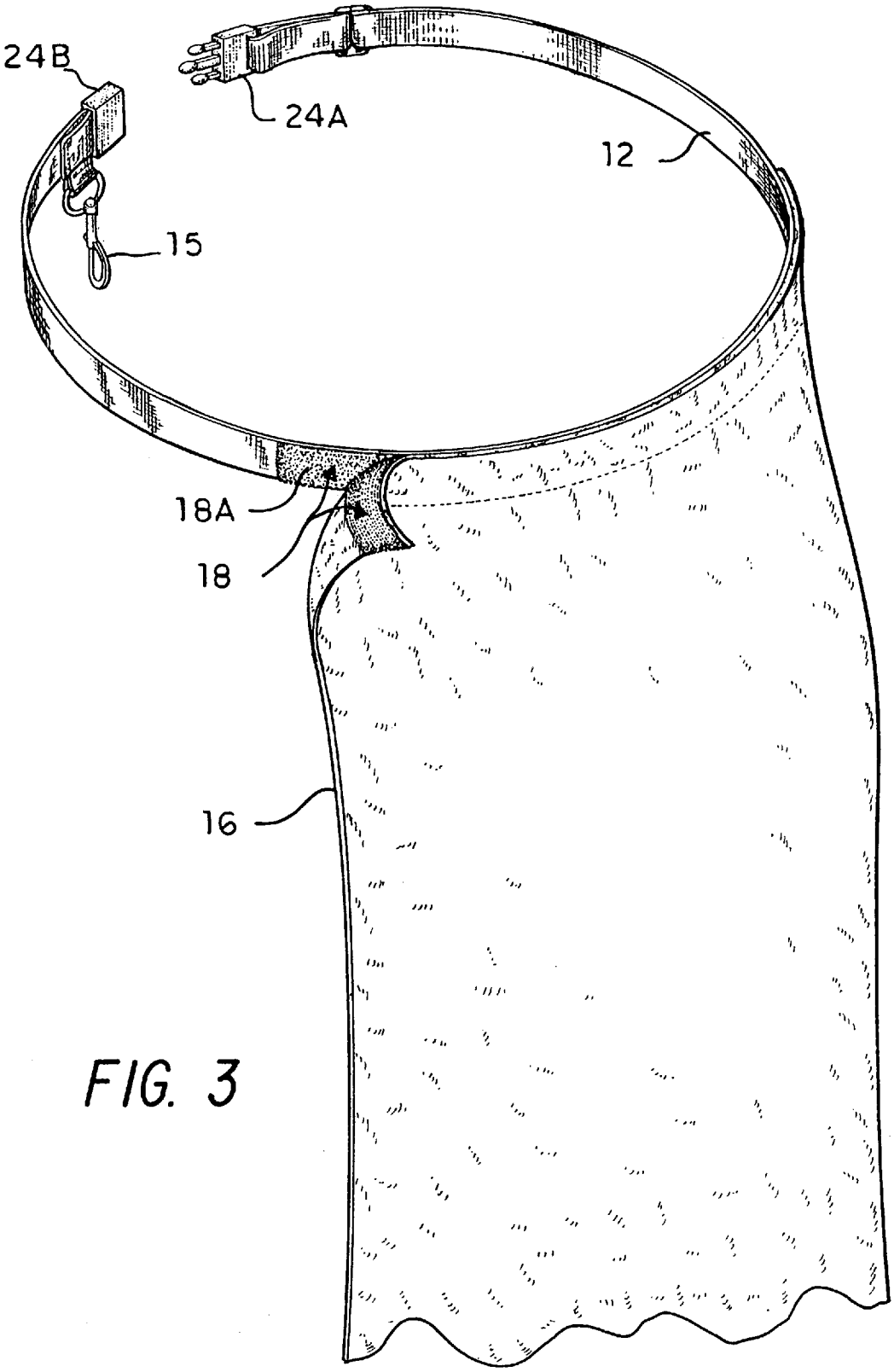
FIG. 3 is a perspective view of the preferred embodiment showing the belt and cushion-flap.

FIG. 3 shows yet another combination wherein only the belt 12 and the cushion-flap 16 are used. Special attention should be made of loop fastener 18A. Since it is conceivable that the user may decide to wear only the belt 12, the user may experience irritation therefrom because the hook fastener 18B can be abrasive to the skin. Another advantage for having the loop material on the belt 12 can be appreciated from an inspection of FIGS. 1, 5 and 7. When the belt 12 and the pack 16 are worn together, items may be stored within the bottom compartment 26, where such items could become snagged on hook material if it were present on the belt 12. The use of loop material on the belt 12 prevents this from happening.

Figure 6:
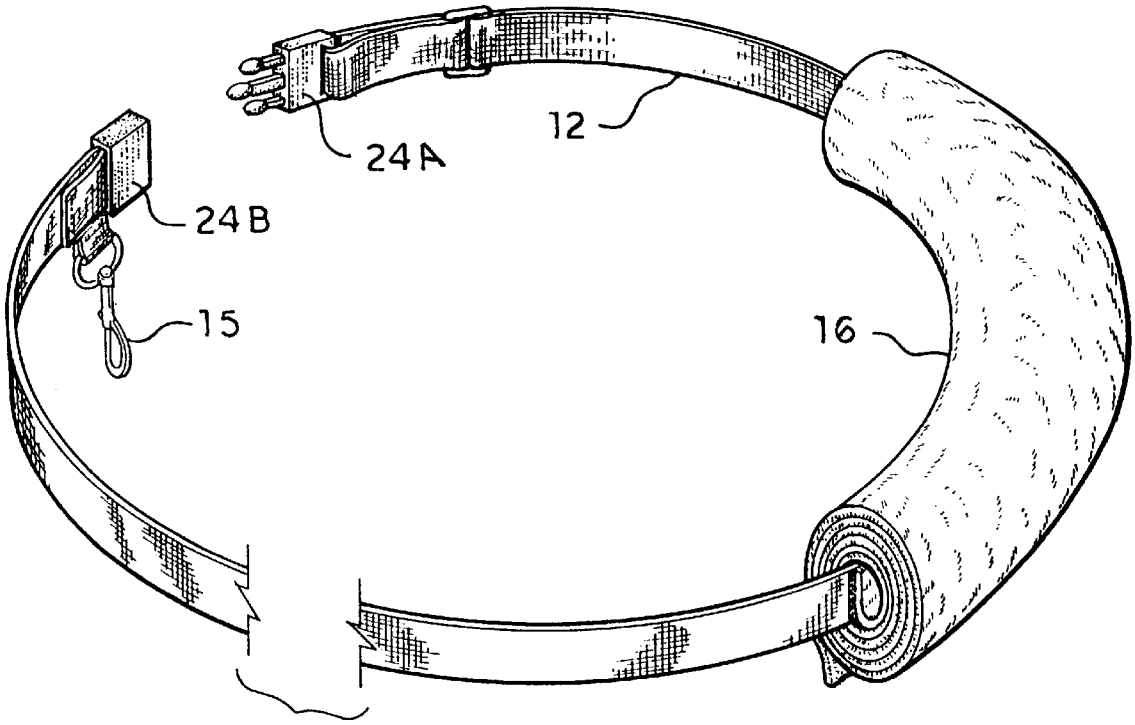
FIG. 6 is a perspective view of the invention as seen in FIG. 3, but with the cushion-flap rolled up.

FIG. 6 shows the belt 12 and the cushion-flap 16 configuration of FIG. 3 in a rolled up position. By rolling the cushion-flap 16 around the belt 12 the user can easily walk, jog, run or ride a bike without becoming encumbered by the cushion-flap 16. When worn in this configuration the user can use the key holder 15 to safely secure a set of keys.

Figure 4:
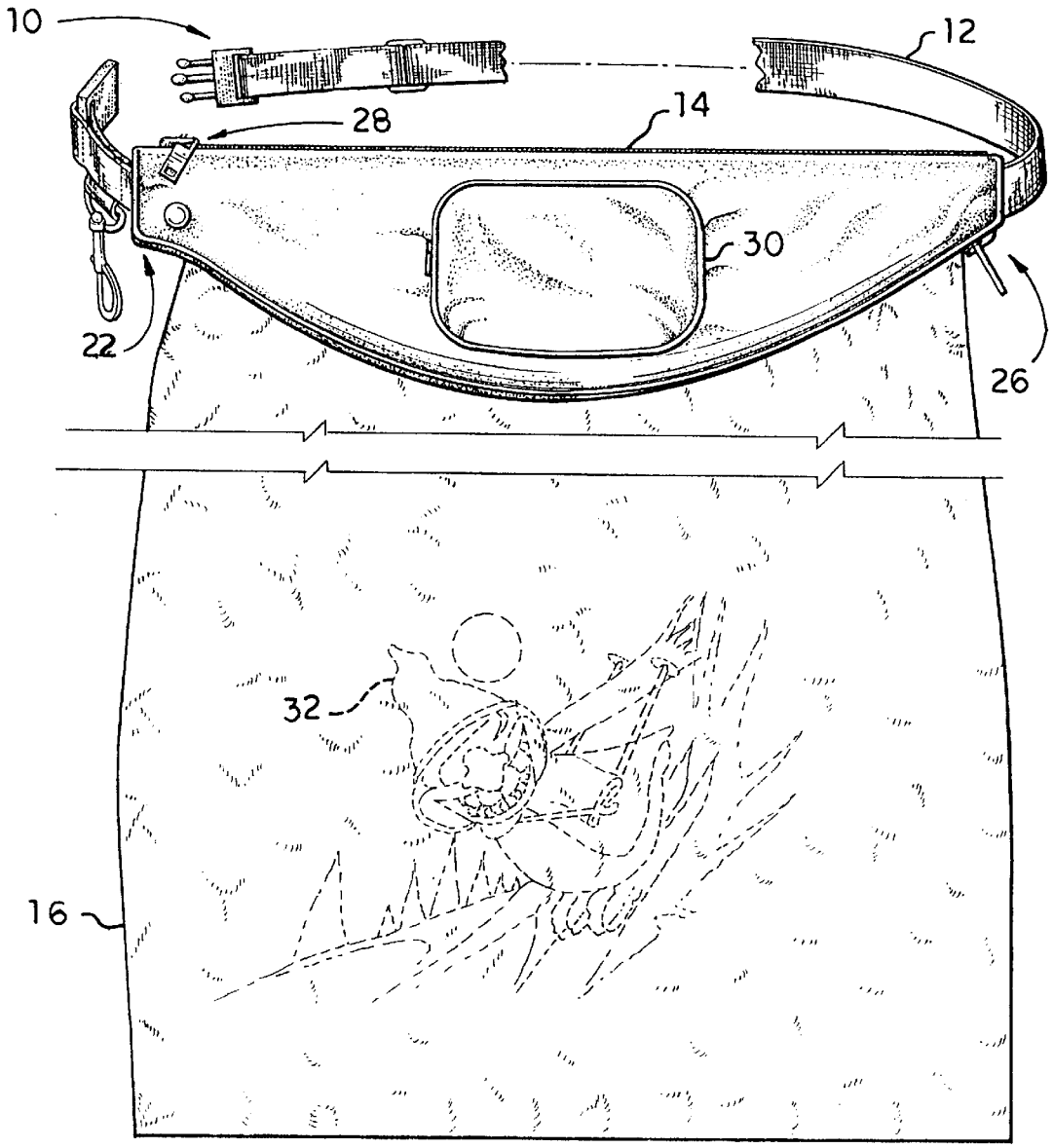
FIG. 4 is a partial front elevational view of the preferred embodiment showing in combination the belt, cushion-flap and pack.

Turning now to FIG. 4 of the drawings, combination belt pack 10 is shown with the cushion-flap 16 hanging in a downward position from the belt 12 and the pack 14. In this position, the cushion-flap 16 functions as both an emblem bearer and a shield for the posterior area of the user. Many people today love to display humorous messages, witty sayings or their favorite designs or logos, be it from sports teams, school mascots or cartoon characters to name a few. By placing popular symbols on the cushion-flap 16 the users can add fun and excitement to a device that heretofore had a purely functional use. The addition of the symbol transforms the combination belt pack 10 into a personalized article that is both extremely practical while also functioning as a conversation piece. As stated above, the cushion-flap 16 also is useful as a shield to protect the posterior area when the user has need to sit on surfaces that are not completely clean, or are soaking wet, or offer little or no comfort.

Figure 5:
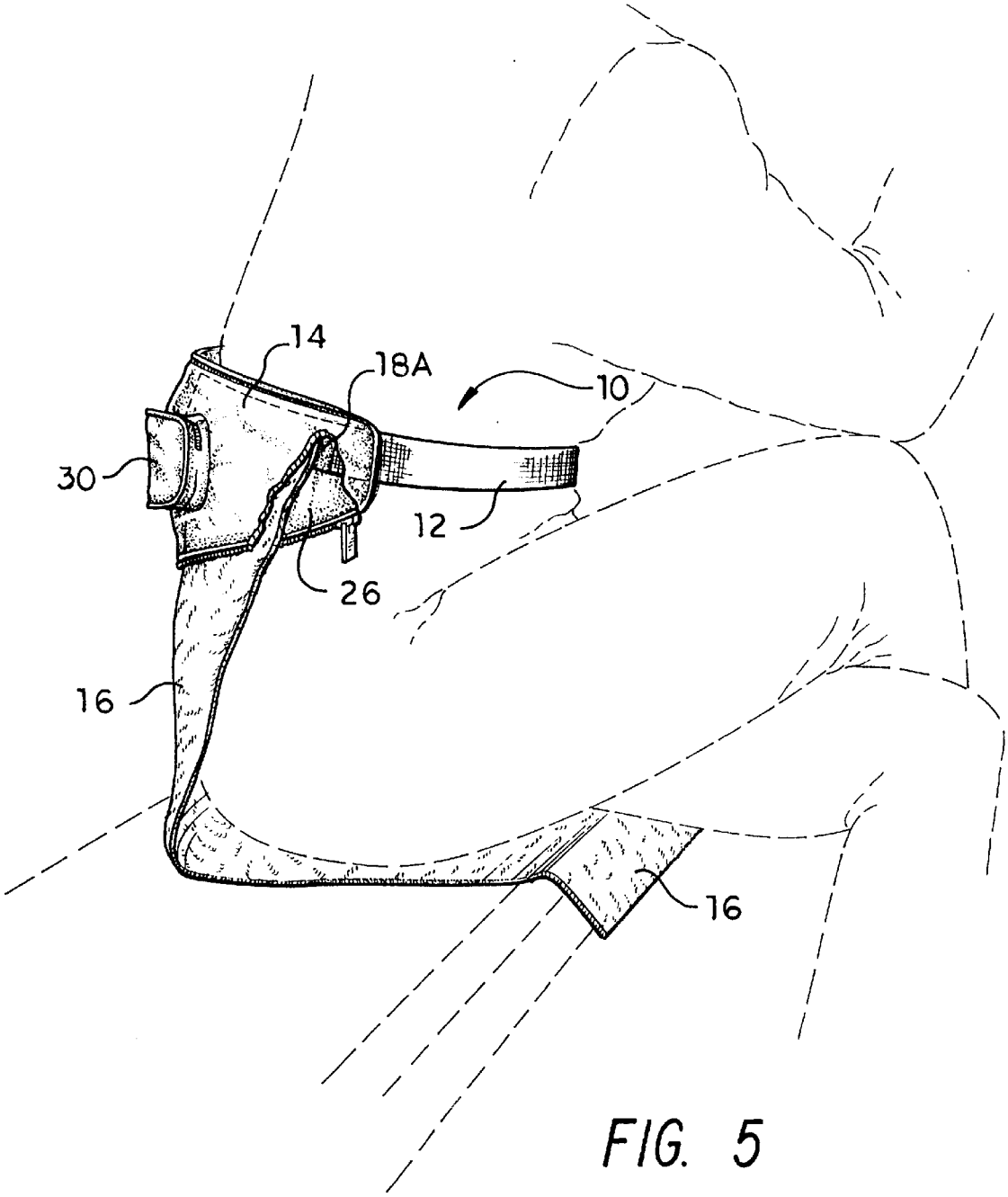
FIG. 5 is an environmental perspective view of the preferred embodiment, showing one use of the invention.
Figure 7:
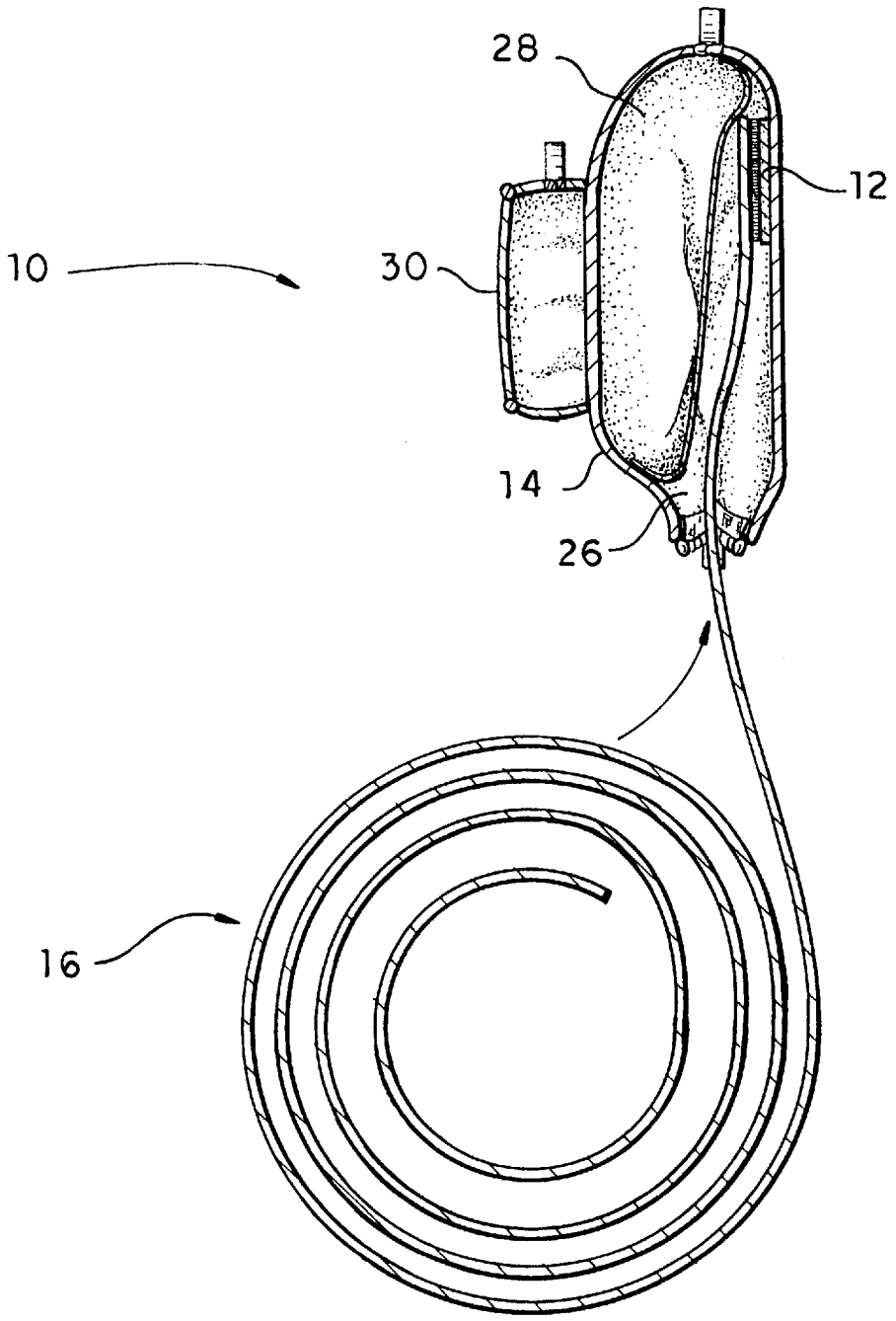
FIG. 7 is a vertical sectional view, taken along an approximate centerline of the invention as seen in FIG. 4, but with the cushion-flap partially rolled up.

FIG. 5 shows the cushion-flap 16 utilized as a seat cushion to both protect the user's clothing from becoming soiled while simultaneously providing a padded cushion upon which to sit. With the cushion-flap 16 attached to the belt 12 within the pack 14, it will hang down a sufficient distance to completely cover the user's buttocks. Thus, when the user sits down, the cushion-flap 16 functions as a comfortable, waterproof seat. The cushion flap 16 may be constructed from at least one layer of insulative material or can be fabricated from insulative material having a layer of water resistant material formed on opposite sides of the insulative material. The cushion-flap 16 is preferably made of a double sided nylon covered neoprene material that is approximately 1.5 mm thick and is both waterproof and thermally insulative. The thickness allows the cushion-flap 16 to adequately protect the user while being thin enough such that when rolled up, it can fit within the pack 14. This is best shown in FIG. 7 wherein by rolling the cushion-flap 16 into a tight cylindrical shape the user can place the cushion-flap 16 completely within the bottom compartment 26. By securing the bottom compartment 26, the user can store a wet and dirty cushion-flap 16 without risk of soiling his or her clothing. The top compartment 28 and the rear compartment 30 are both separated from the bottom compartment 26 by waterproof and/or water-resistant material which will keep any items stored therein from becoming soiled from a wet and dirty cushion-flap 16. In practice, to roll the cushion-flap 16 upwards and into the bottom compartment 26 the user first pulls or rotates the belt 12 around the waist until the cushion-flap 16 is in front of the user, and next the user rolls the cushion-flap 16 up into the bottom compartment 26 and then secures the bottom compartment 26. At this time the user can then pull or rotate the belt 12 until the combination belt pack 10 is back to its original position.

There is an additional feature worthy of note regarding the unique structural combination of the belt 12, the cushion-flap 16, and the connection provided by the hook and loop fasteners 18A, 18B. The interconnection of the cushion-flap 16 to the belt 12 is, of course, a breakaway connection. Thus, a safety feature is provided, in that should the flap 12 become snagged in, for example, rotating machinery, vehicular parts (e.g., a bicycle wheel), bleacher seat components, etc., the cushion-flap 16 may simply tear away from the belt 12, at the hook and loop fastener connection 18A, 18B without any injury to the user.

It is to be understood that the present invention is not limited to the sole embodiment described above, but encompasses any and all embodiments within the scope of the following claims.

I claim:

1. A multi-purpose storage and protective device comprising:

a belt having opposed connectable ends;

a pack containing therein at least a first compartment and a second storage compartment, each of said first and second storage compartments having respective top and bottom elongate openings with respective top and bottom closing means for selectively opening and closing each of said storage compartments;

said pack having opposed open ends and opposed confronting walls integrally connected along a common edge opposite said bottom elongate opening to define said second compartment, one of said ends being a closed loop and the other of said ends being an open loop with first securing means for removably securing said pack to said belt, wherein when said pack is removably secured to said belt, the belt passes through said closed loop, said second storage compartment and said open loop with said first securing means closing said open loop to secure said pack about said belt; and a flap having opposed ends, one of said ends having second securing means for removably securing said flap to said belt, said flap being configured and dimensioned for storage in said second storage compartment.

2. The multi-purpose storage and protective device according to claim 1 further comprising means for securing keys to said belt.

3. The multi-purpose storage and protective device according to claim 2 wherein said means for securing keys comprises a key holder attached to said belt.

4. The multi-purpose storage and protective device according to claim 1, wherein said second securing means comprise:

a first fastener connected to said belt; and a second fastener connected to one end of said flap.

5. The multi-purpose storage and protective device according to claim 1, wherein said first securing means comprise:

a third fastener connected to one of said walls adjacent said open loop; and a fourth fastener connected to the other of said walls adjacent said open loop, said fourth fastener being positioned to engage said third fastener to close said open loop.

6. The multi-purpose storage and protective device according to claim 1, wherein said confronting walls are formed of a material selected from the group consisting of waterproof fabrics and water-resistant fabrics.

7. The multi-purpose storage and protective device according to claim 1, wherein said flap is constructed from at least one layer of material.

8. The multi-purpose storage and protective device according to claim 7, wherein said at least one layer of material comprises an insulative material.

9. The multi-purpose storage and protective device according to claim 8, wherein said flap further comprises first and second layers of water-resistant material formed on opposed sides of said insulative material.

10. The multi-purpose storage and protective device according to claim 1, wherein said cushion flap includes a decorative design strategically placed on one side of said cushion-flap.

11. The multi-purpose storage and protective device according to claim 1 wherein said pack includes a separate third compartment having a third opening with a third closing means.

* * * * *